United States Patent [19]

Spengler et al.

[11] 4,184,286

[45] Jan. 22, 1980

[54] DAMAGE-FREE ACTUATING MECHANISM FOR AN ACTION TOY

[75] Inventors: Duane Spengler, West Falls; David S. Darling, East Aurora, both of N.Y.

[73] Assignee: The Quaker Oats Company, Chicago, Ill.

[21] Appl. No.: 862,731

[22] Filed: Dec. 21, 1977

[51] Int. Cl.[2] ..... A63H 11/10

[52] U.S. Cl. ..... 46/205; 46/114

[58] Field of Search ..... 46/205, 204, 114, 220

[56] References Cited

U.S. PATENT DOCUMENTS

| | | | |
|---|---|---|---|
| 2,147,600 | 2/1939 | Fisher | 46/204 X |
| 2,679,126 | 5/1954 | Doe et al. | 46/114 |
| 2,835,074 | 5/1958 | Crawford et al. | 46/205 X |
| 3,238,665 | 3/1966 | Doe | 46/204 X |
| 3,292,300 | 12/1966 | Lescher et al. | 46/205 X |

*Primary Examiner*—Louis G. Mancene
*Assistant Examiner*—Mickey Yu
*Attorney, Agent, or Firm*—Cumpston & Shaw

[57] ABSTRACT

A damage-free actuating mechanism for an action toy of the type in which an object is reciprocally moved between retracted and extended positions in response to the rotation of a pair of wheels. The actuating mechanism comprises a crankshaft secured to a pair of wheels, and a pivotal lever coupling the crank of the crankshaft to the object. Accordingly, normal rotation of the wheels and crankshaft imparts reciprocal movement to the object between retracted and extended positions. A fulcrum of the actuating mechanism is provided in engagement with one portion of the lever, and a resilient member biases the one portion of the lever into engagement with the fulcrum during normal rotation of the wheels and crankshaft. The resilient member further allows the one portion of the lever to move away from the fulcrum in those situations in which the object is manually pushed from its extended position to its retracted position while the wheels and crankshaft are stationary. This allows pivotal movement of the lever about the crank in its uppermost position rather than about the fulcrum without damaging the lever.

4 Claims, 5 Drawing Figures

DAMAGE-FREE ACTUATING MECHANISM FOR AN ACTION TOY

BACKGROUND OF THE INVENTION

1. Field of the Invention

This invention relates generally to action toys, and more particularly to a damage-free actuating mechanism for an action toy.

2. Description of the Prior Art

Action toys of the type in which an object is reciprocally moved between retracted and extended positions in response to the rotation of a pair of wheels are well known in the art. In such action toys, the wheel motion is imparted to the object through an actuating mechanism comprising a crankshaft secured to the wheels, and one or more levels coupling the crank of the crankshaft to the object. To Applicants' knowledge, none of these action toys have means for preventing damage to the actuating mechanism in the event a child manually presses on the object forcing it from its extended position into its retracted position while the crank and wheels are stationary. Damage may be prevented if the wheels slip or turn while the force is applied or if the parts of the actuating mechanism are made exceedingly rugged or strong. However, as a practical matter, most of the parts of the actuating mechanism are made of thin plastic which are unable to withstand the excessive forces imparted thereto resulting in breakage. Furthermore, most forces tending to move the object into its retracted position also tend to force the wheels against the wheel supporting surface. This minimizes the likelihood that the wheels will slip on the surface to absorb the excessive forces applied to the actuating mechanism. Applicants' invention is believed to obviate these and other disadvantages of prior art action toys by providing a damage-free actuating mechanism which allows movement of the object from its extended position to its retracted position while the crank and wheels are stationary without damaging the actuating mechanism.

SUMMARY OF THE INVENTION

In accordance with a preferred embodiment of the invention, a damage-free actuating mechanism for an action toy is disclosed. The action toy is of the type in which an object is reciprocally moved between retracted and extended positions via the actuating mechanism in response to the rotation of a pair of wheels secured to a crankshaft. The actuating mechanism comprises a pivotal lever coupling a crank of the crankshaft to the object. One portion of the lever is biased by resilient means into engagement with fulcrum means during normal rotation of the wheels and crankshaft. In the event the object is manually forced from its extended position into its retracted position while the wheels and crankshaft are stationary, the resilient means allows the one portion of the lever to move away from the fulcrum means as the lever is pivoted about the crank whereupon the actuating mechanism is not damaged.

In a more specific aspect of the invention, one end of the pivotal lever has a first opening extending therethrough to form a bar at the end thereof. The opposite end of the lever engages the object, and an intermediate portion of the lever has a slotted opening for receiving the crank. The fulcrum means comprises a tubular member having opposed slots forming a pair of spaced apart arcuate projections having shoulders at the ends of the slots. One of the projections extends through the first opening with the bar resting on the shoulders. The resilient means comprises a compressed helical spring mounted in the tubular member and having one end in engagement with the bar for biasing the bar into engagement with the shoulders.

The invention and these and other advantages will become more apparent from the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
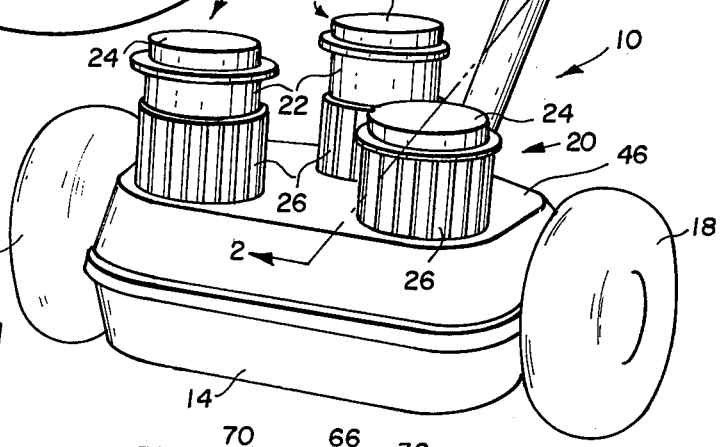
FIG. 1 is a perspective view of an action toy in which the damage-free actuating mechanism is incorporated.

With reference to FIG. 1, a pull-type action toy 10 is disclosed in which the damage-free actuating mechanism 12 of this invention is incorporated. The action toy 10 has a body 14 rotatably supporting crankshaft 16 to which a pair of wheels 18 are secured for rotation therewith. A plurality of objects 20 such as cylindrical heads 22 with brimmed hats 24 are positioned within sleeves 26 on body 14. Actuating mechanisms 12 are mounted within body 14 and couple wheels 18 to objects 20. Accordingly, when action toy 10 is pulled by a handle 28, wheels 18 will rotate on a wheel supporting surface such as a floor, not shown, causing each of the objects 20 to be moved between retracted and extended positions. In the retracted position, the face of head 22 is hidden behind sleeve 26 as seen in FIGS. 2 and 5, and in the extended position of the object 20 the face is visible above sleeve 26 as seen in FIG. 4.

Figure 2:
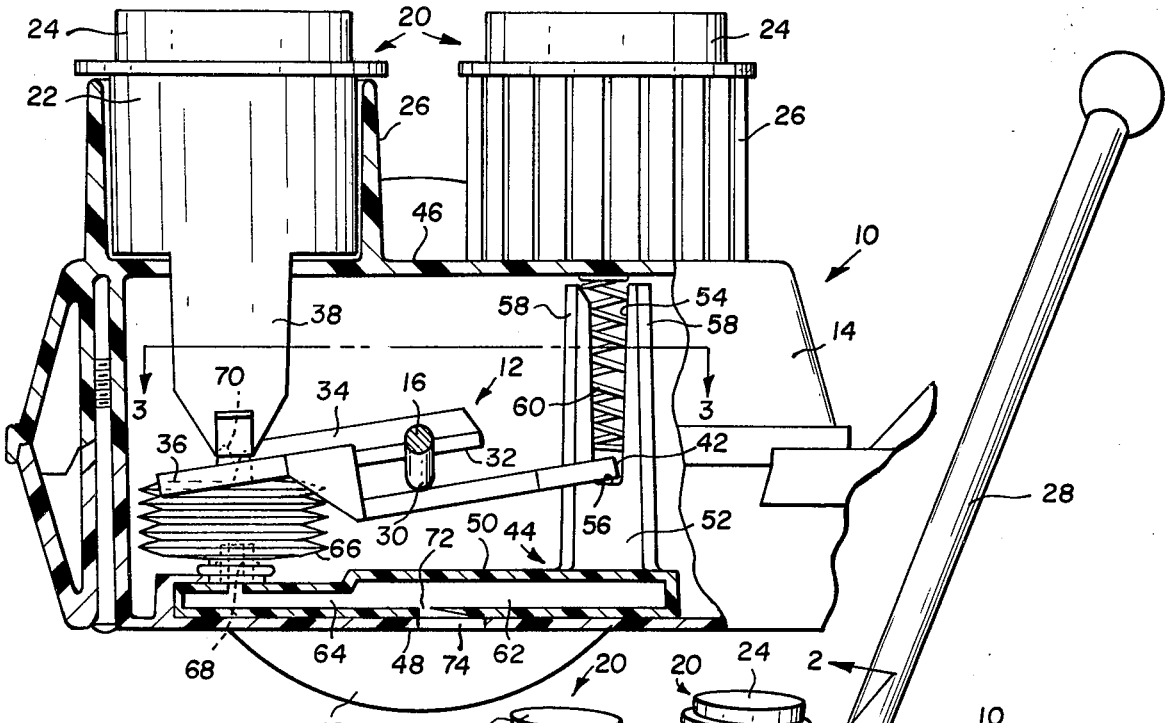
FIG. 2 is an enlarged section view taken substantially along line 2—2 of FIG. 1 and illustrating the position of the crank and actuating mechanism for moving the object to its retracted position.
Figure 3:
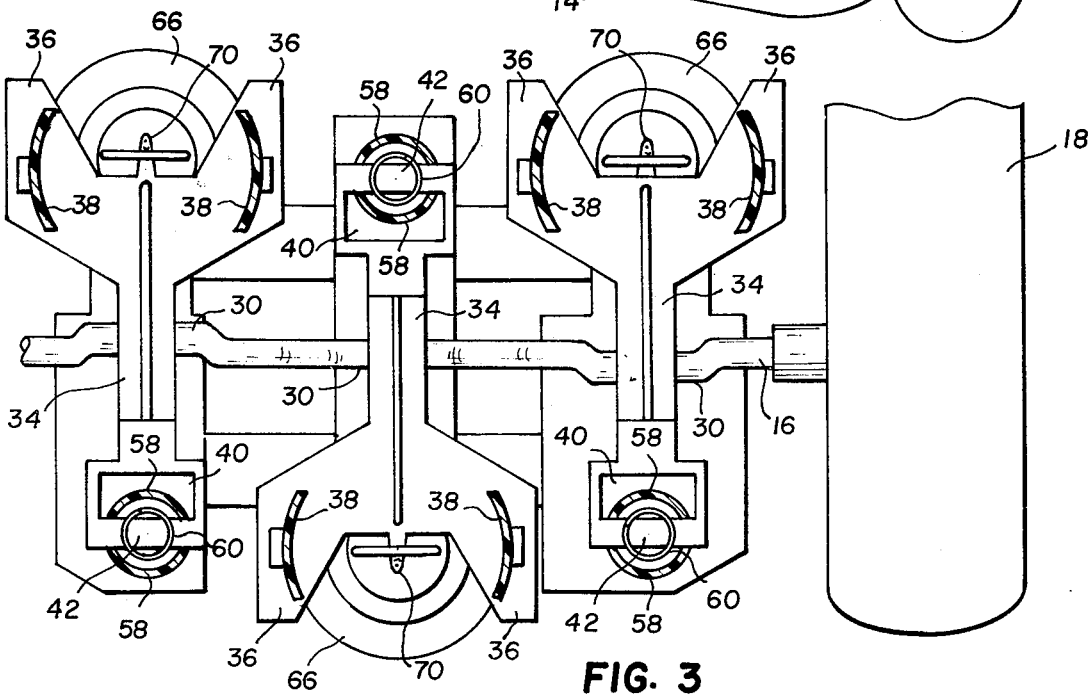
FIG. 3 is a top plan view of the actuating mechanism taken substantially from line 3—3 of FIG. 2.

With particular reference to FIGS. 2 and 3, the damage-free actuating mechanism 12 for action toy 10 is disclosed. Since actuating mechanism 12 is similar for each object 20, only one of such actuating mechanisms will be described in detail. The actuating mechanism 12 comprises crankshaft 16 rigidly secured to the pair of wheels 18 such that rotation of the wheels will impart rotation to the crankshaft. A crank 30 of crankshaft 16 extends through a slotted opening 32 in an intermediate portion of a pivotal lever 34. One end of lever 34 is Y shaped (see FIG. 3) with each arm 36 of the Y engageable with a leg 38 depending from cylindrical object 20. The opposite end of lever 34 has an opening 40 extending therethrough to form a bar 42 at the end of the lever. A housing 44 is interposed between upper and lower walls 46, 48 respectively of action toy body 14 and is rigidly secured thereto. The housing 44 has a base 50, and a tubular member 52 laterally extending from the base. The tubular member 52 has diametrically opposed elongated slots 54 terminating in shoulders 56; the slots further dividing member 52 into a pair of spaced apart projections 58 of arcuate cross section. One of the projections extends through opening 40 in the end of the lever 34. One end of a helical spring 60 captured within tubular member 52 engages and biases bar 42 of lever 34 into engagement with shoulders 56, which form a fulcrum for the lever.

The crank 30 of the crankshaft is in its lowermost position in FIG. 2 and via slotted opening 32 pivots lever 34 to the position illustrated therein. In this position, object 20 moves under the influence of gravity to its retracted position, in which the face of head 22 is hidden by sleeve 26. Now when the wheels 18 and crankshaft 16 are rotated through 180°, crank 30 assumes the position illustrated in FIG. 4. In this position, lever 34 is pivoted on fulcrum 56 causing arms 36 thereof to lift object 20 into its extended position, in which the face of head 22 is fully visible above sleeve 26. Upon continued rotation of wheels 18, object 20 will be reciprocally moved between its retracted and extended positions.

Figure 4:
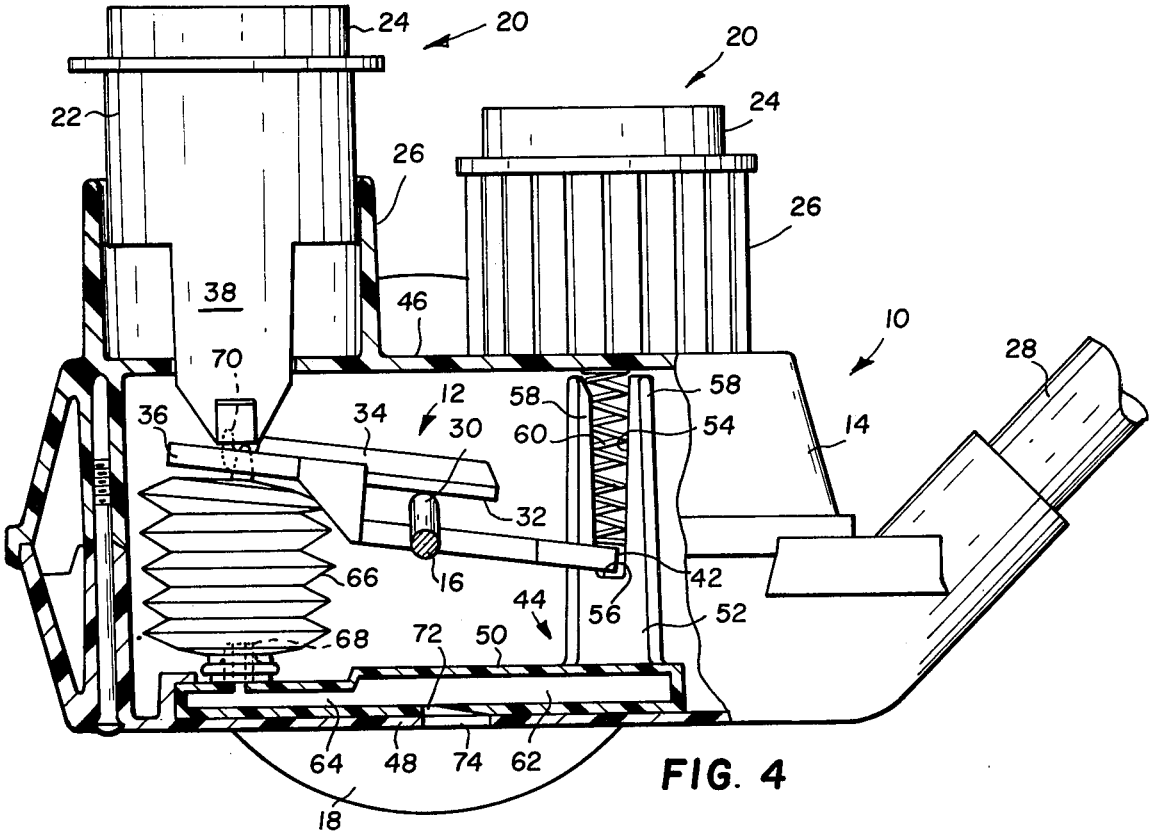
FIG. 4 is a view similar to FIG. 2 illustrating the position of the crank and actuating mechanism for moving the object to its extended position.
Figure 5:
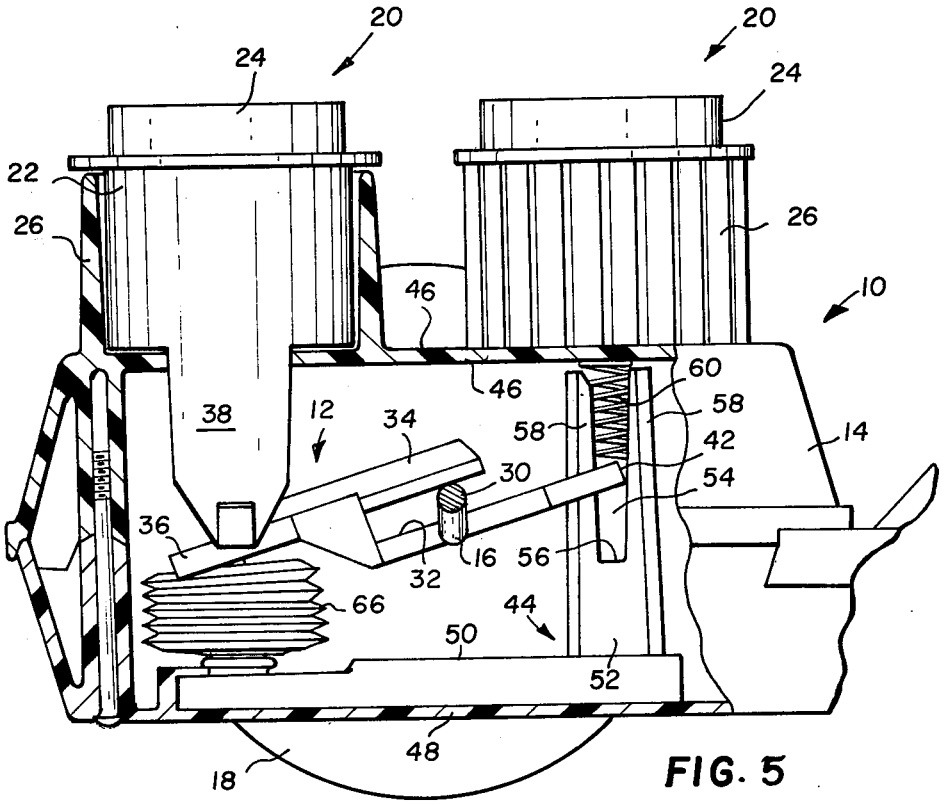
FIG. 5 is a view similar to FIG. 4 illustrating the position assumed by the actuating mechanism in the event the object is forced from its extended position to its retracted position while the crank and wheels are stationary.

Now with reference to FIG. 4, if lever bar 42 were pivotally secured to the shoulders or fulcrum 56, i.e., not allowed to move away from the fulcrum, a problem would occur if object 20 were forced downwardly from its extended position into its retracted position while crank 30 and wheels 18 are maintained stationary. In this situation, with the bar end 42 of lever 34 unable to move, the lever tends to pivot around crank 30 in its uppermost position. If the pivot lever 34 were unable to force crank 30 to its lowermost position causing wheels 18 to slip on the supporting surface, it is likely that the lever would break at slotted opening 32. Since any downward force imparted to object 20 and body 14 also increases the frictional resistance of wheels 18 to turning or slipping, this increases the likelihood that the crank and wheels will not turn or slip and that lever 34 will be broken.

This problem of damage to lever 34 of actuating mechanism 12 is eliminated by this invention as illustrated in FIG. 5. As illustrated therein, downward movement of object 20 to its retracted position pivots lever 34 about crank 30 in its uppermost position. Since bar end 42 of lever 34 is free to move, it moves along slots 54 compressing spring 60. As soon as the force is removed from object 20, spring 60 returns lever 34 undamaged to the position illustrated in FIG. 4 and also returns object 20 to its extended position.

The base 50 of housing 44 is provided with a sound cavity 62 and a passageway 64 extending through a nipple 68 for connecting the cavity to a bellows 66. One end of bellows 66 is secured to passageway 64 through nipple 68, and the opposite end is secured to a finger 70 on lever 34. Accordingly, each time actuating mechanism 12 moves object 20 between its retracted and extended positions, bellows 66 is moved between its contracted and expanded positions respectively. The bellows force air through passageway 64 and openings 72, 74 in the housing and wall respectively to produce a whistling sound in a manner well-known in the art. Therefore, every time object 20 is moved from its extended position to its retracted position, a whistle sound is emitted.

Although three cylindrical objects 20 having circular cross sections are illustrated in the action toy of FIG. 1, a greater or lesser amount of objects may be used and the objects can have any suitable cross section other than circular. Also, cranks 40 on crankshaft 16 are preferably angularly spaced apart 120° in FIG. 1 so that the movement of objects 20 are staggered; that is, while one object is in its retracted position, another object is between its retracted and extended position, and the third object is in its extended position.

The invention has been described in detail with particular reference to a preferred embodiment, but it will be understood that variations and modifications can be effected within the spirit and scope of the invention as described.

What is claimed is:

1. A damage-free actuating mechanism for an action toy of the type in which an object is moved between retracted and extended positions in response to the rotation of a pair of wheels, comprising in combination:

a shaft to which said pair of wheels is secured, said shaft having a crank;

fulcrum means;

a pivotal lever having one end portion in engagement with said fulcrum means, the opposite end portion in engagement with said object, and a midportion in engagement with said crank whereby rotation of said wheels and said crankshaft imparts pivotal movement to said lever which imparts movement to said object between said retracted and extended positions; and resilient means for biasing said one end portion of said lever into engagement with said fulcrum means during normal rotation of said wheels and said crankshaft for imparting movement to said object between said retracted and extended positions, and for allowing said one end portion of said lever to move away from said fulcrum means when said object is manually pushed from its extended position to its retracted position while said wheels and said crankshaft are substantially stationary whereby pivotal movement of said lever about said crank in its uppermost position is permitted without damage to said lever.

2. The actuating mechanism of claim 1 wherein said resilient means comprises a spring.

3. A damage-free actuating mechanism for an action toy of the type in which an object is moved between retracted and extended positions in response to the rotation of a pair of wheels, comprising in combination:

a shaft to which said pair of wheels is secured, said shaft having a crank;

a pivotal lever coupling said crank to said object whereby rotation of said wheels and said crankshaft imparts movement to said lever which imparts movement to said object between said retracted and extended positions;

fulcrum means engageable by one portion of said lever, said fulcrum means comprising a tubular member having a slot forming a shoulder at the end of said slot, and said one portion of said lever comprising a bar interposed in said slot and resting on said shoulder; and resilient means comprising a compressed spring in said tubular member having one end in engagement with said bar for biasing said bar into engagement with said shoulder during normal rotation of said wheels and said crankshaft for imparting movement to said object between said retracted and extended positions, and for allowing said bar to move away from said shoulder when said object is manually pushed from its extended position to its retracted position while said wheels and said crankshaft are substantially stationary whereby pivotal movement of said lever about said crank is permitted without damage to said lever.

4. The actuating mechanism of claim 3 wherein one end of said lever has a first opening extending therethrough to form a bar at the end thereof, the opposite end of said lever engages said object and an intermediate portion of said lever has a slotted opening for receiving said crank; said fulcrum means comprises a tubular member having opposed elongated slots forming shoulders at the ends of said slots, said slots dividing said tubular member into a pair of arcuate projections of which one of said arcuate projections extends through said first opening with said bar resting on said shoulders; and said resilient means comprises a compressed spring in said tubular member having one end in engagement with said bar for biasing said bar into engagement with said shoulders.

* * * * *